United States Patent [19]

Takagaki

[11] Patent Number: 4,801,348

[45] Date of Patent: Jan. 31, 1989

[54] FILM SUPPLY APPARATUS

[75] Inventor: Nobuyuki Takagaki, Nara, Japan

[73] Assignee: Fuji Seal Industry Co., Ltd., Osaka, Japan

[21] Appl. No.: 43,499

[22] Filed: Apr. 29, 1987

[30] Foreign Application Priority Data

May 27, 1986 [JP] Japan ..... 61-123178

[51] Int. Cl.[4] ..... B65C 9/04; B65C 9/14

[52] U.S. Cl. ..... 156/456; 156/458; 156/567; 156/568; 156/571; 156/DIG. 26; 156/DIG. 31

[58] Field of Search ..... 156/450, 456, 567, 568, 156/571, DIG. 31, 572, 458, DIG. 26

[56] References Cited

U.S. PATENT DOCUMENTS 3,723,228 3/1973 Schaltegger ..... 156/571

4,032,388 6/1977 Dunning ..... 156/568

4,293,365 10/1981 Geyser et al. ..... 156/568

4,581,097 4/1986 Carter et al. ..... 156/568

*Primary Examiner*—Michael Wityshyn

*Attorney, Agent, or Firm*—Lackenbach Siegel Marzullo & Aronson

[57] ABSTRACT

A film supply apparatus is described which is to be disposed alongside a container transport line and adapted to supply a film strip to be affixed to the lateral side of each container fed along said transport line. The apparatus includes at least one film suction element having an arcuate suction surface adapted to hold the film strip in position under suction. The film suction element successively transfers a film strip to each container the result of a composite motion consisting of its motion toward and away from the container and the rotary motion thereof in the circumferential direction of its arcuate suction surface.

4 Claims, 5 Drawing Sheets

FILM SUPPLY APPARATUS

BACKGROUND OF THE INVENTION

1. Field of the Invention

The present invention relates to a film supply apparatus for affixing a film to the surface of a container such as a bottle, can or the like.

2. Description of the Prior Art

The conventional method of affixing a heat-shrinkable plastic film strip (hereinafter referred to briefly as film) to the surface of a container with the intent of the film strip functioning as a label or as a label and protective film generally comprises cutting the film to size, lapping one of its ends on the other to form a tubing, sleeving it over the container and subjecting it to thermal shrinking treatment with a hot blast of air so as to bring the film into intimate contact with the container surface.

Recently, for purposes of simplying the process and increasing the productivity and so on, an alternative method has been proposed which is such that a film is directly wrapped around the container, the lapped ends welded to form a tubing, and the tubing subjected to thermal shrinking treatment. And as a means for use in the application of film to the container in such a process, the apparatus depicted in FIG. 5 was proposed (Japanese Patent Application No. 60-109982). Referring to FIG. 5, this apparatus includes a container transport table 100 and a film supply unit 110. The film supply unit 110 comprises a pair of rolls 111, 112, a belt 113 thrown on said rolls and driven at a predetermined speed, and a vacuum suction system (not shown) connected to said belt 113, a vacuum suction force for attracting the film acting on the surface of the belt 113. The film F paid out from a film roll 120 onto the surface of the belt 113 is cut to size by a cutter (not shown) disposed in an intermediate position therebetween, retained in position under suction on the belt 113 and further fed in the direction of the arrowmark as the belt is driven.

The container transport table 100 is a rotary disk element adapted to spin about its center axis at a constant speed (in the clockwise direction in the illustration) and a plurality of container holder bases 101 are disposed along its circumferential periphery at substantially equispaced intervals. Disposed on one side of each container holder base 101 is a sucker plate 130 which is driven in the vertical direction by a lift means (not shown) from a position juxtaposed to the lateral side of a container X set on said container holder base 101 to a position downwardly apart from said lateral side of the container or vice versa and is adapted to rotate around the container at a constant speed (in the counterclockwise direction in the illustration) in said position juxtaposed to the lateral side of the container.

The sucker plate 130 has two rows of vacuum suction holes 131, 132 discharging on its exterior surface, with the left (in the illustration) row of vacuum suction holes 132 being adapted to retain the leading edge (F1) of film F while the other row of vacuum suction holes 131 is adapted to retain the trailing edge (F2) of film F, both under suction. The vacuum suction force acting at these rows of vacuum suction holes 131, 132 is controlled ON and OFF in association with the rotation of the sucker plate 130.

The apparatus further includes a film pressure bonding unit (140) which is located behind a container X on the container holder base 101 and adapted to advance and retreat in the radial direction of the container transport table in association with the rotation of the table. The pressure bonding unit 140 includes a front pressor face portion 141 having a built-in heat source and, as described in detail hereinafter, presses and heat-welds the lapped leading and trailing edges of film F.

FIG. 6 [I] through [II] show the process of wrapping a container with film by means of the above apparatus. Wrapping starts at the position P1 and ends at the position P2. Thus, the rotation of the container transport table 100 causes the container X on the container holder base 101 to reach the wrapping start position P1 along with the sucker plate 130. At the same time, the film F paid out and retained under suction on the belt 113 of the film supply unit arrives at the vicinity of the container X and its leading edge F1 is severed from the belt 113 surface and sucked onto the surface of the row of vacuum suction holes 132 of the sucker plate 130 under the influence of the suction force acting at the holes 132 (FIG. 6 [I]). As the sucker plate revolves around the container X, the film F whose leading edge F1 is retained in position under suction on the sucker plate 130 is peeled off the belt 113 surface and wrapped around the container X. When the sucker plate 130 has substantially completed one revolution around the container X and reached the wrapping end position P2, the trailing edge F2 of film facing the sucker plate 130 is severed from the belt 113, sucked on the sucker plate 130 by the suction force acting in the row of vacuum suction holes 131 and lapped over the front part of the leading edge F1 which has already been sucked. This completes the wrapping process (FIG. 6 [II]).

When the film F has been wrapped around the container X, the sucker plate 130 carrying said leading and trailing edges F1, F2 of film F makes a one-half revolution and stops in the position juxtaposed to the film pressure bonding unit 140 behind the container. Then, the pressure bonding unit 140 advances toward the sucker plate 130 and its pressor face portion 141 presses the lapped part of leading and the trailing edges F1, F2 of film F to thereby weld (heat weld) the joint (FIG. 6 [III]). As this welding is completed, the sucker plate 130 stops delivering the vacuum suction force and is withdrawn downward from the position intermediate between the film F and container X. The film F wrapped around the container X is then subjected to thermal shrinkage treatment whereby it is shrink-fitted onto the surface of the container.

Thus, the wrapping of the container with film is effected by driving the sucker plate 130 around the container but since the container itself is also moving in association with the rotation of the transport table, the motion of the sucker plate 130 is the composition of the rotary motion of the sucker plate itself around the container and the motion of the container accompanying the rotation of the sucker plate. On the other hand, the supply of film to the sucker plate is done as a constant-speed linear motion by the travel of the belt 113. Therefore, during the film wrapping process, film F tends to slip on the surface of the sucker plate and on the surface of the belt. As the film slips, there occurs a vertical or lateral misalignment of the leading and trailing edges of film to be lapped so that the condition of film on the container and, hence, the market value of the product are adversely affected.

This slippage of film and the consequent wrapping defect occur also when the film is directly wrapped around the container by rotating the container about its own axis without the use of a sucker plate.

SUMMARY OF THE INVENTION

It is an object of the present invention to provide an improved film supply apparatus which overcomes the above-mentioned disadvantages.

The film supply apparatus according to the present invention is based on the principle which comprises driving a container along a container transport line, causing a sucker plate revolving around the container to suck and retain a film, causing the container to be wrapped with the film as the result of rotation of the sucker plate or by rotating the container itself about its own axis and affixing the film directly to the surface of the container with an adhesive. Thus, the film supply apparatus of the present invention comprises a film suction means having an arcuate suction surface adapted to hold a film in position under suction and capable of advancing or retreating with respect to a container in a container transport line and rotatable in the circumferential direction of the arcuate suction surface, a driving mechanism for driving said film suction means in such a manner that the film is transferred from the arcuate suction surface of said film suction means to the outer surface of the container while the arcuate suction surface holding the film in position maintains a predetermined spatial relationship with respect to the lateral side of the container in said container transport line from a start point to an end point of wrapping the container with the film, and a rocking mechanism for swinging said film suction means.

In accordance with the present invention, the supply of film is done as the result of composition of the motion of the container along a container transport line and the rotary motion of a sucker plate revolving around the container or of the container itself so that the film is accurately wrapped around or glued onto a predetermined surface area of the container without slippage and misalignment.

Furthermore, the film supply apparatus of the present invention enables one to drive the film suction means at a high speed in line with the high-speed transport of the container along the container transport line so that the wrapping or gluing operation can be carried out with high efficiency.

DESCRIPTION OF THE PREFERRED EMBODIMENTS

Figure 1:
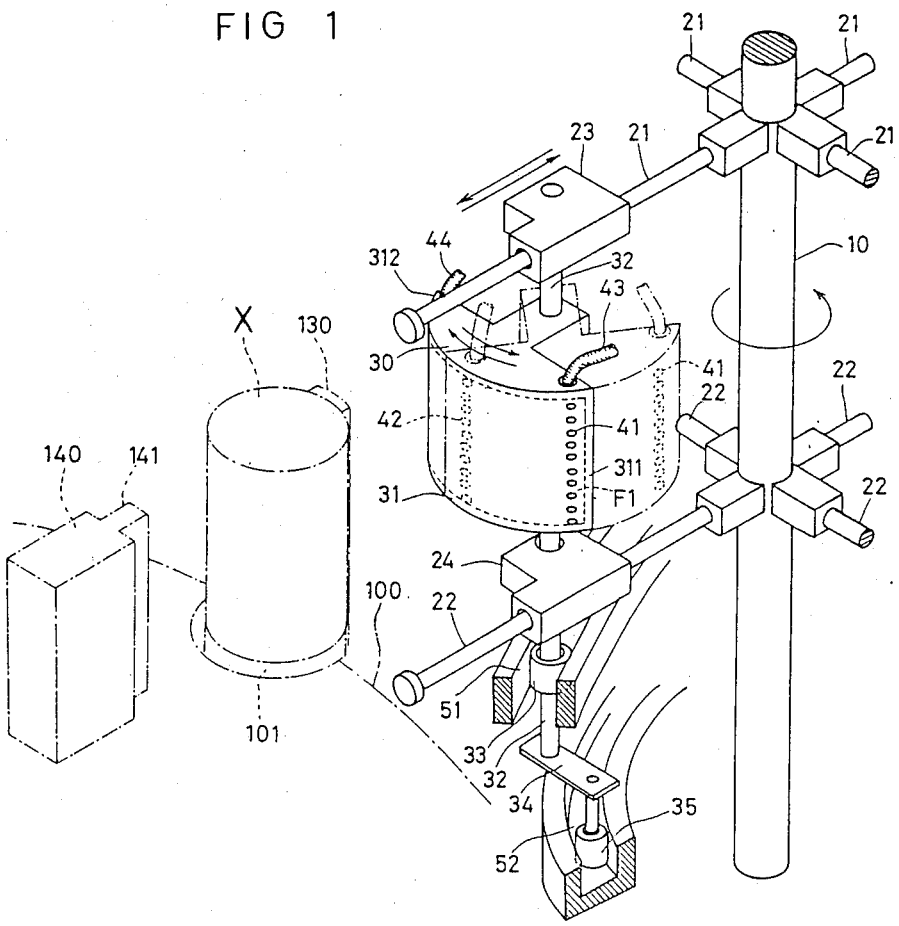
FIG. 1 is a perspective view showing the main part of a film supply apparatus as an embodiment of the present invention.

Referring, now, to FIG. 1 illustrating the film supply apparatus according to the present invention, the apparatus generally includes a revolving vertical main shaft 10 (hereinafter referred to briefly as the main shaft), horizontal slide shafts 21, 22 mounted radially on said main shaft 10, a film suction element 30 having an arcuate suction surface 31 adapted to retain a film F under suction, a groove cam 51 adapted to cause said film suction element 30 to advance or retreat along said slide shafts 21, 22, and a groove cam 52 adapted to cause said film suction element 30 to swing about a pivot shaft 32. The slide shaft 21 mounted at an upper position of said main shaft 10 and the slide shaft 22 mounted at a lower position thereof are parallel to each other and the horizontal slide shafts 21 and 22 have slide blocks 23 and 24, respectively, as slidably mounted thereon.

The film suction element 30 has a pivot shaft 32 parallel to the main shaft 10 and is swingably mounted on the slide blocks 23 and 24 via said pivot shaft 32. Two rows of vacuum suction holes 41, 42 are communicating with the corresponding ends of the arcuate suction surface 31 of the film suction element 30 and connected to a vacuum suction system (not shown). The film F is retained on the arcuate suction surface 31 as its leading and trailing edges F1, F2 are attracted by suction to the rows of vacuum suction holes 41, 42, respectively. It should be understood that said rows of vacuum suction holes may each be a slit-like opening.

The pivot shaft 32 extends through the lower slide block 24 and has a cam follower bearing (33) within the groove cam 51 as sleeved thereon. Further at its lower end, the pivot shaft 32 is fitted with a lever 34, to which a cam follower 35 within the groove cam 52 is secured in a position offset from the axis of the pivot shaft 32.

With the rotation of the main shaft 10, the film suction element 30 secured to the slide shafts 21, 22 via the pivot shaft 32 advances or retreats along the slide shafts 21, 22 as the bearing 33 is guided by and along the groove cam 51 and, in this course of movement, as the cam follower 35 is guided along the groove cam 52, it is swung about the pivot shaft 32 in the circumferential direction of the arcuate suction surface 31.

Figure 2:
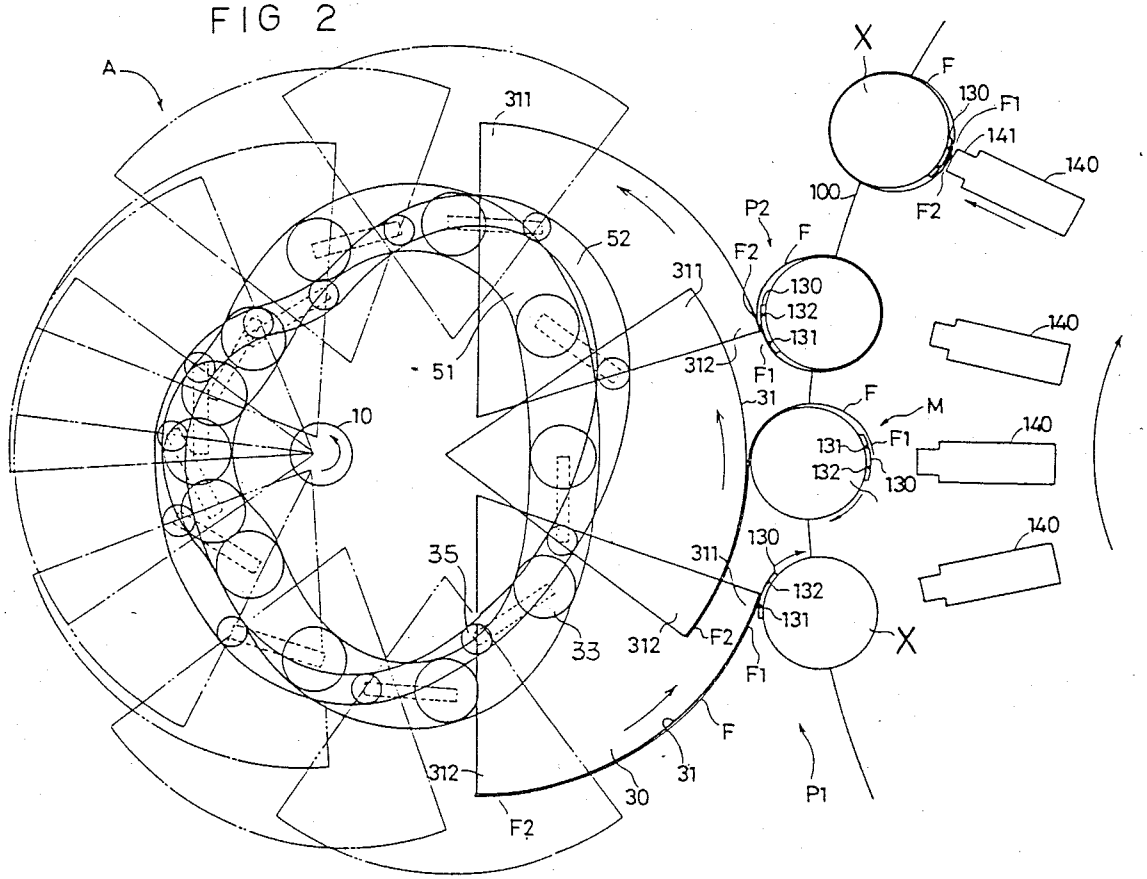
FIG. 2 is a diagrammatic representation of the film wrapping actions of the apparatus according to the present invention.

FIG. 2 shows the motion of the film suction element 30 as the composition of its linear (advancing-retreating) and swing motions associated with the rotation of the main shaft 10 and the phase of supply of film F to the sucker plate 130 revolving around a container X on a container transport table 100. With the rotation of the main shaft, the film suction element 30 spins counterclockwise about the main shaft at a constant rotational speed (a constant angular velocity), while the container X revolves clockwise at a constant speed in response to the rotation of the transport table 100. Further, the sucker plate 130 revolves clockwise around the container X at a constant rotational speed. In FIG. 2, P1 denotes the start position of film wrapping and P2 denotes the end position.

As shown, with the main shaft 10 revolving, the cam follower 33 is guided by the groove cam 51 so that the film suction element 30 travels from the wrapping start position P1 to the wrapping end position P2. In this process, its arcuate suction surface 31 advances into the vicinity of the lateral side of the container X. To the contrary, when the film suction element 30 travels on the opposite side of the main shaft 10, the arcuate suction surface 21 retreats into the vicinity of the main shaft 10. Further, in order that a constant proximity may be maintained between the suction surface 31 and the lateral side of the container X throughout the course from the wrapping start position P1 to the wrapping end position P2, the film suction element 30 retreats slightly in the course from the start position P1 to an intermediate position M, while it advances by the same distance as the distance of retreat in the course from the intermediate position M to the wrapping end position P2. Furthermore, as the cam follower 35 is guided by the groove cam 52, in the course from the back side of the main shaft to the wrapping start position P1, the film suction element 30 is swung clockwise about the pivot shaft 32 and arrives at the wrapping start position P1 in a posture rotated clockwise through a predetermined angle. The film suction element 30 is swung counterclockwise in the course from this position P1 to the wrapping end position P2.

When the film suction element 30 arrives at the wrapping start position P1 as the result of composition of the above linear (advance-retreat) motion and swing motion, the front end 311 of its arcuate suction surface 31 is juxtaposed to the sucker plate 130 facing the lateral side of the container X which has arrived at the wrapping start position P1. Then, the leading edge F1 of the film retained on the arcuate suction surface 31 is severed from the surface 31 and taken up on the surface of the row of suction holes 131 of the sucker plate 130 by the suction force acting at the row of suction holes 131.

With the rotation of the sucker plate 130, the film F whose leading edge F1 has been sucked onto the row of vacuum suction holes of the sucker plate 130 is severed from the arcuate suction surface 31 and wrapped around the container X. Then, at the wrapping end position P2, the trailing edge F2 of the film on the arcuate suction surface 31 comes into juxtaposition with the sucker plate which has substantially gone through one revolution around the container X.

The trailing edge F2 of the film thus juxtaposed to the sucker plate 130 is severed from the arcuate suction surface 31 and taken up on the row of vacuum suction holes 132 of the sucker plate 130 by the suction force acting at said row of vacuum suction holes 132. At the same time, the end portion of the trailing edge F2 of film is lapped over the leading edge F1 of film previously taken up on the row of vacuum suction holes 131. In this manner, the wrapping of the container X with film F is accomplished without slippage and misalignment.

In order that the leading edge F1 and trailing edge F2 of the film may be transferred smoothly from the suction surface 31 to the sucker plate 130 at the wrapping start position P1 where the leading edge F1 retained by the film suction element 30 is taken over by the sucker plate 130 and the wrapping end position P2 where the trailing edge F2 of film is taken up by the sucker plate 130, respectively, an ON-OFF control of vacuum suction is provided so that the application of the suction force may be suspended at the front row of vacuum suction holes 41 and the back row of vacuum suction holes 42 at said position P1 and position P2, respectively.

When the container X has been wrapped in film F as described above, the sucker plate 130 makes a one-half revolution while it keeps hold on both edges of the film F and stops revolving in the position juxtaposed to a pressure unit (140) disposed behind the container. The pressure unit 140 advances toward this sucker plate 130 and its pressor face portion 141 having a built-in heater presses the lapped part of film F, whereby the lapped film edges are welded (heat-sealed). Instead of this thermal welding procedure, the lapped edges may be glued using an adhesive. After the lapped edges of film F are welded or glued, the sucker plate 130 ceases to deliver the vacuum suction force and is withdrawn downward from the position between the film F and the container X. The film F wrapped around the container X is thereafter subjected to thermal shrinkage treatment whereby it is intimately shrink-fitted on the surface of the container X.

When the sucker plate 130 is not used but, instead, the film is directly glued onto the surface of the container with an adhesive previously applied to the whole or a portion of the film surface (for example, the leading and trailing edges or the margins of film), the container transported by the container transport table is caused to spin about its own axis and the relative position of the suction surface 31 of the film suction element 30 with respect to the lateral side of the container is set so that the they come into appropriate contact with each other in the course from a gluing start position (corresponding to the wrapping start position P1 in FIG. 2) to a gluing end position (corresponding to the wrapping end position P2). Except for the above departures, the same operation as described above is performed. Thus, by the composition of the linear and swing motions of the film suction element 30, the film is glued to a predetermined surface area of the container.

Figure 3:
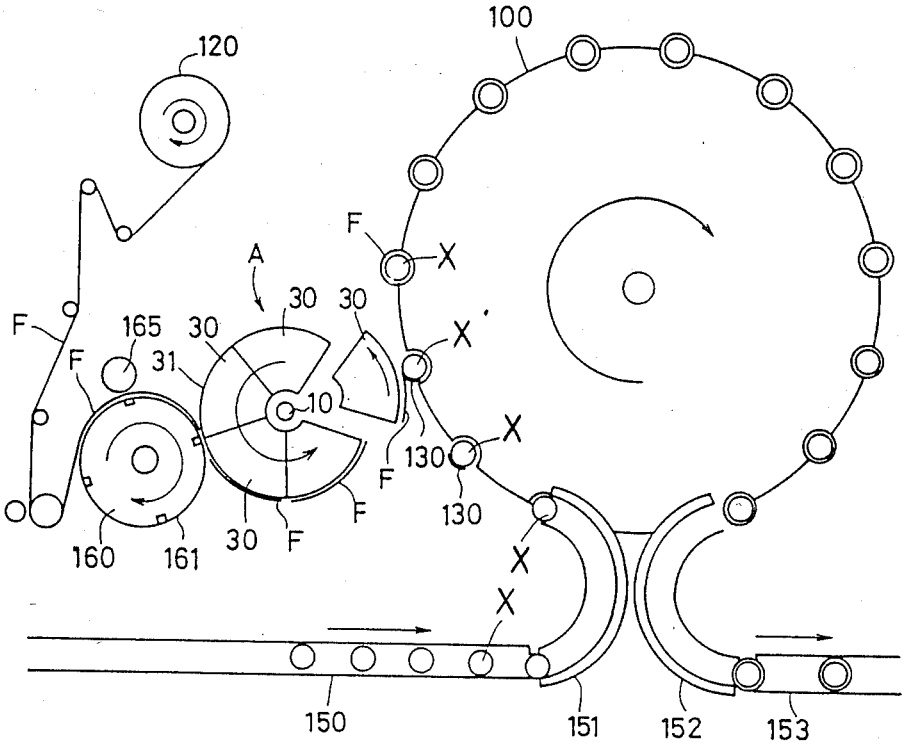
FIGS. 3 and 4 each is a schematic plan view showing the film wrapping machine equipped with the film supply apparatus according to the present invention.

FIG. 3 shows an equipment wherein the container X transferred by the container transport table 100 is wrapped with a film by the film supply apparatus A according to the present invention. The film supply apparatus A in this illustration has five film suction elements 30 about its main shaft 10 and as the main shaft 10 is driven, the five film suction elements 30 are driven in the counterclockwise direction while they undergo the composit motion of linear (advance-retreat and swing motions which was described with reference to FIG. 2.

The container X to be wrapped in film F is supplied by a container feed conveyer 150, guided by a guide 151, and set on one of container holder bases attached to the periphery of the container transport table 100 which is turning in the clockwise direction. Alongside each container X is a sucker plate 130 which revolves around the container X in association with the rotation of the transport table 100.

The reference numeral 100 designates a film cutter roll 160 adapted to cut the film F to a predetermined length and supply the cut film to the film suction element 30 of the film supply apparatus A, with its peripheral surface 161 being disposed in substantial contact with the suction surface 31 of the suction element 30 and driven clockwise at a predetermined constant speed. The peripheral surface 161 of the film cutter roll 160 is provided with vacuum suction holes so that the film F fed from a film roll 120 is taken up and retained on the peripheral surface 161 by the suction force acting at the vacuum suction holes. At the point of contact with the film suction element 30, the film is sucked by rows of vacuum suction holes 41, 42 of the suction surface 31, whereby it is severed from the peripheral surface 161 and taken up on the suction surface 31. Cutting of film F is done as a cutter 165 is brought against film F on the film cutter roll 160 at predetermined intervals of time and the film cut to size is accurately sucked up and retained on the suction surface 31 of the film suction element 30 because the rotation of the film cutter roll 160 is synchronized with the rotation of the film suction element 30. With the rotation of the main shaft 10 in association with the rotation of the container transport table 100, the film F retained on the film suction element 30 is transferred from the suction surface 31 of the element 30 to the sucker plate 130 and wound around the container X as the film suction element 30 undergoes said composite motion of linear and swing motions. The film suction element 30 which has supplied the film to the sucker plate 130 returns to the film cutter roll 160, receives another strip of film F, and repeat the same above procedure, whereby containers X on the transport table are sequentially wrapped with film F. When the lapped edges of the film F wrapped around the container are glued or welded together, the sucker plate is withdrawn from the position between the film and the container. The container X so wrapped with film is taken out via a guide 152 onto an exit conveyer 153 and submitted to the next production stage.

Figure 4:
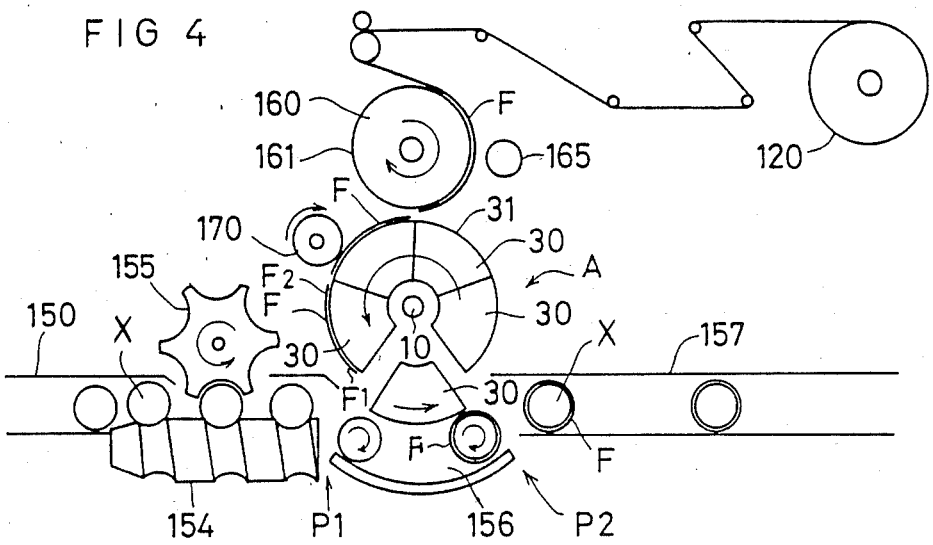
Figure 5:
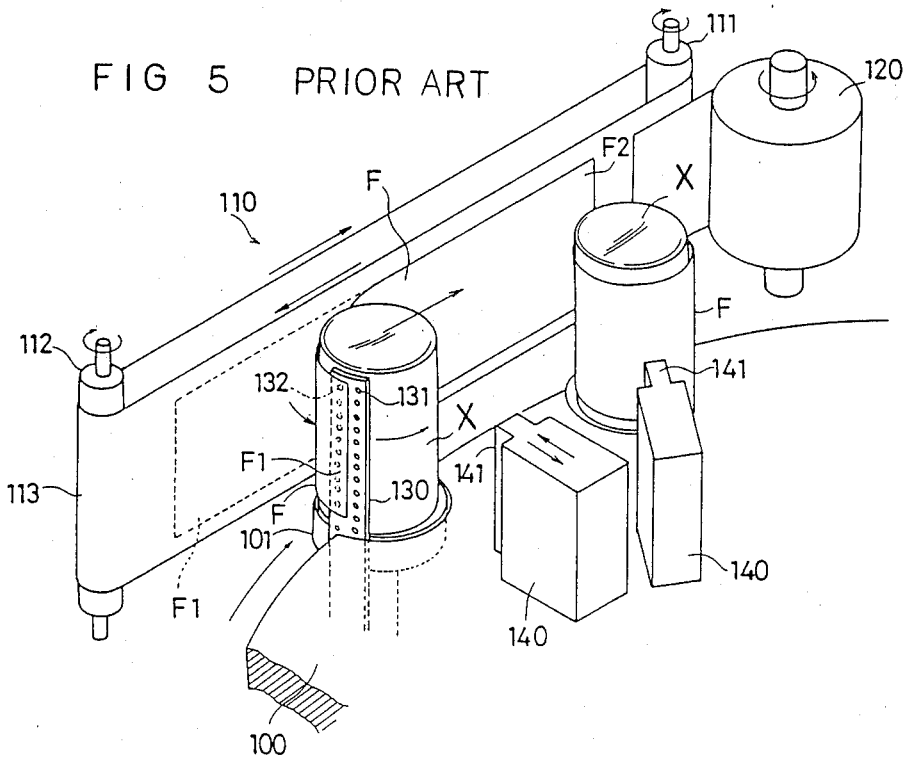
FIG 5 PRIOR ART
FIG. 5 is a perspective view showing the main part of the conventional apparatus.
Figure 6:
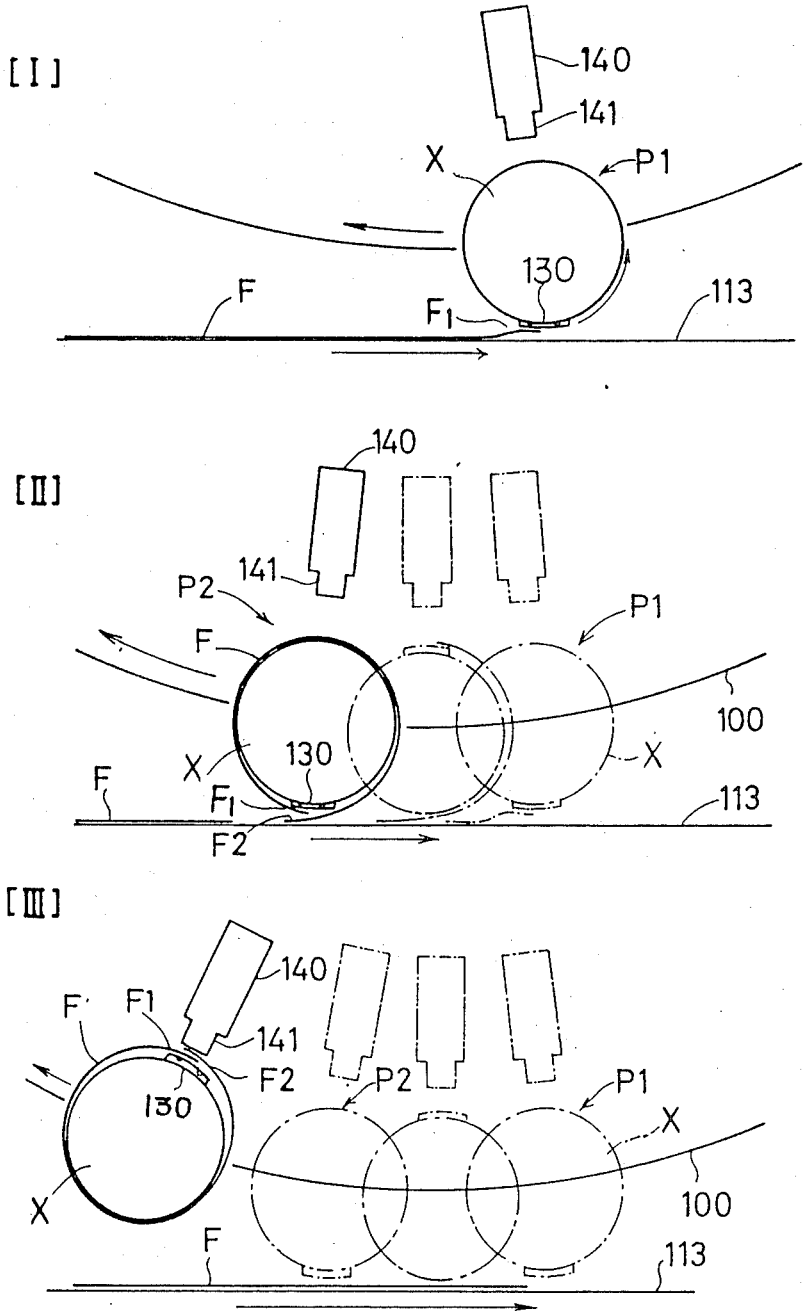
FIG 6 PRIOR ART
FIG. 6 I through III are schematic diagrams showing the film wrapping process in the conventional apparatus.

FIG. 4 shows an equipment wherein a film is supplied and glued to the container X transferred by a container transport conveyer 150 by means of the film supply apparatus according to the present invention.

In the film supply apparatus A, as in the embodiment shown in FIG. 3, five film suction elements disposed about a main shaft 10 are driven counterclockwise in response to the rotation of the main shaft 10 and, at the same time, undergo a composite motion of said linear (advance-retreat) and swing motions.

The container X is introduced at a predetermined pitch by the rotation of a screw conveyer 154 and a timing star wheel 155, travels through a curved path 156 along the arcuate suction surface 31 of the film suction element 30 during the course from the gluing start position P1 to the gluing end position P2, and finally withdrawn from the equipment by an exit conveyer 157 for subsequent processing. During the course from the gluing start position P1 to the gluing end position P2, the container travels while it is driven clockwise about its own axis by a rotary drive means not shown.

The transfer of film from the film cutter roll 160 disposed behind the film supply apparatus A to the film suction element 30 is performed in the same manner as shown in FIG. 3. Thus, the film F continuously supplied from the film roll 120 is sucked and retained on the peripheral surface 161 of the film cutter roll 160 spinning in the clockwise direction, cut by the cutter 165, and transferred to the suction surface 31 of the film suction element 30.

Indicated at 170 is an adhesive applicator roll which comes into contact with the surface of film F retained on the suction surface 31 of the film suction element 30 and thereby transfers an adhesive to the film surface.

The film F retained on the suction surface 31 of the film suction element 30 and carrying the adhesive is transported by the suction element undergoing a composite motion of linear and swing motions in association with the rotation of the main shaft 10 to the gluing start position P1 where its leading edge F1 contacts the surface of the container X at a predetermined position thereof and glued thereto by the action of the adhesive. Then, as the suction element traverses to the gluing end position P2, the film is progressively peeled off from the suction surface 31 starting at the leading edge F1 and toward the trailing edge F2 and glued to the surface of the container X. As the plurality of film suction elements 30 sequentially undergo the above action, strips of film F are successively glued to the containers on the container transport conveyer. According to the cut length, film F is glued around the entire circumference of the container surface or over a part of the circumference (for example, one-half of the circumference).

What is claimed is:

1. A film supply apparatus for gluing a film to the surface of a container which is driven along a container transport line while it is spun about its own axis, generally comprising a revolving vertical main shaft adapted to revolve in association with the movement of a container in a container transport line, first and second horizontal slide shafts mounted radially on said revolving vertical main shaft, said first slide shaft being vertically spaced above said second slide shaft, a film suction element positioned between said first and second slide shafts, said film suction element having an arcuate suction surface adapted to retain a film under suction, capable of advancing and retreating with respect to a container in said container transport line and swingable in the circumferential direction of said arcuate suction surface, a first groove cam means adapted to cause said film suction element to advance and retreat in association with the rotation of said revolving vertical main shaft in such a manner that the arcuate suction surface of the film suction element retaining the film under suction is maintained in a constant contact with the lateral side of a container in said container transport line without slippage during the course from a gluing start position to a gluing end position, and a second groove cam means for swinging said film suction element, said first groove cam means being positioned beneath said second slide shaft but above said second groove cam means, and a pivot shaft parallel to said vertical main shaft for connecting said film suction element to said first slide shaft above said suction element and to said second slide shaft below said suction element.

2. The film supply apparatus of claim 1, further comprising a first slide block for connecting said pivot shaft to said first slide shaft;

and further comprising a second slide block for connecting said pivot shaft to said second slide shaft.

3. The film supply apparatus of claim 2, further comprising a first cam follower sleeved on said pivot shaft and located within said first groove cam means.

4. The film supply apparatus of claim 3, further comprising a lever fitted onto the lower end of said pivot shaft, and a second cam follower secured to said lever in a position offset from the axis of said pivot shaft and located within said second groove cam means, and said lever being position in the space between said first and said second groove cam means.

* * * * *